US005425618A

United States Patent [19]

Janigro et al.

[11] Patent Number: 5,425,618

[45] Date of Patent: Jun. 20, 1995

[54] MULTISTAGE PUMP PROVIDED WITH MODULAR INTERNAL COMPONENTS MADE OF WEARPROOF MATERIALS

[75] Inventors: Aldo Janigro, Monza; Maurizio Valsecchi, Casarile; Fiorenzo De Bastiani, Seveso, all of Italy

[73] Assignee: Lowara S.p.A., Montecchio Maggiore, Italy

[21] Appl. No.: 161,517

[22] Filed: Dec. 6, 1993

[30] Foreign Application Priority Data

Dec. 16, 1992 [IT] Italy ..... MI92A2871

[51] Int. Cl.[6] ..... F01D 1/02

[52] U.S. Cl. ..... 415/199.1; 415/200; 277/96.2

[58] Field of Search ..... 415/170.1, 199.1, 200; 277/96.2

[56] References Cited

U.S. PATENT DOCUMENTS

| | | | |
|---|---|---|---|
| 3,285,185 | 11/1966 | Feltus . | |
| 3,437,045 | 8/1969 | Tremain . | |
| 4,872,808 | 10/1989 | Wilson | 415/170.1 |
| 5,088,893 | 2/1992 | Gilbert et al. | 415/200 |
| 5,133,639 | 7/1992 | Gay et al. | 415/170.1 |
| 5,186,604 | 2/1993 | Iorio et al. | 415/200 |

FOREIGN PATENT DOCUMENTS

| | | |
|---|---|---|
| 0460809 | 11/1945 | Belgium . |
| 0353611 | 2/1990 | European Pat. Off. . |
| 1263094 | 4/1961 | France . |
| 2145772 | 4/1985 | United Kingdom . |

*Primary Examiner*—John T. Kwon

*Attorney, Agent, or Firm*—Guido Modiano; Albert Josif

[57] ABSTRACT

A multistage pump of the type including a jacket, a shaft which is coaxial to the jacket and connected to an electric motor, and active pumping stages rigidly coupled to the shaft; each stage is formed by an impeller with a front ring and by a distribution element facing the ring with the interposition of an annular supporting element shaped like an inverted bowl; the radial-vane impellers and their distribution elements are rigidly coupled to the jacket made of a highly wearproof material, and the impellers are mounted on the shaft and can move axially or float with a preset stroke with respect to the associated bowl-shaped element, whereas at least one annular supporting and sealing element for the impeller is interposed between the front ring of each impeller and the associated bowl-shaped element, is made of a material which is more wearproof than the impellers, and is suitable to withstand the axial thrusts of the various stages and prevent any fluid seepage during pump operation.

8 Claims, 2 Drawing Sheets

MULTISTAGE PUMP PROVIDED WITH MODULAR INTERNAL COMPONENTS MADE OF WEARPROOF MATERIALS

BACKGROUND OF THE INVENTION

The present invention relates to a multistage pump provided with modular internal components made of highly wearproof materials such as to give the pump a high specific fluid-dynamics performance.

As it is known, multistage electric pumps are essentially power-using machines constituted by an electric motor and a multistage pump which are mutually integrated; they are used to raise fluids, particularly water.

Conventional multistage pumps comprise a containment jacket shaped like a cylindrical tube. An impeller supporting shaft is arranged coaxially to the tube, and is connected to the driving shaft in a downward region and kept in position by a bush or the like in an upward region.

A plurality of impellers with radial vanes is rigidly anchored on said rotating shaft, coaxially to the containment jacket, in equidistant positions; each impeller is arranged opposite to an annular body which acts as a redirection-diffusion element for the fluid drawn by the respective impeller; each diffuser is rigidly coupled to the internal surface of said cylindrical jacket by means of an annular body which is substantially bowl-shaped and is generally termed "bowl".

Each assembly constituted by an impeller and the associated fixed diffuser thus constitutes a stage of the pump. Furthermore, each impeller with radial vanes is provided, in a front region, with a disk-like ring which closely faces the associated bowl-shaped element to avoid as much as possible unwanted transfers of fluid during pump operation.

The stream of fluid drawn by the impellers from a duct located at an end of the containment jacket is expelled from the other end of said jacket, where there possibly is a check valve suitable to prevent backflow. These known types of multistage pumps generally have impellers and diffusers made of metal or plastic materials which, after prolonged use, are subject to wear and thus to a progressive decrease in their fluid-dynamics performance and consequently in their volumetric efficiency. Furthermore, due to the rigidity of the structure of the stages, all the axial thrusts generated by the various stages are discharged onto a thrust bearing which is usually associated with the driving shaft; in addition, the structure of these known pumps does not prevent any abrasive particles contained in the drawn fluid from penetrating between the front ring of the impellers and the surface of the bowls which face said ring and thus damaging the ring and the associated impellers.

In practice, therefore, the nominal rotation rate and consequently the specific fluid-dynamics performance and volumetric efficiency of conventional pumps are affected by the respective structural characteristics, by the materials used and by the dimensions, particularly by the diameter of the containment jacket.

SUMMARY OF THE INVENTION

A principal aim of the present invention is therefore to provide a multistage pump, with integrated pump and motor, conceived and structured so as to eliminate the drawbacks and limitations of current multistage pumps and, most of all, such as to allow very high nominal rotation rates and a significantly higher specific fluid-dynamics performance than obtainable with known pumps.

Another aim of the invention is to provide a multistage pump which is structured so as to eliminate transmission of the axial thrusts of the various stages to the impeller supporting shaft and thus also eliminate the conventional thrust bearing, and so as to be highly compact and consequently, for an equal performance, have smaller containment jacket outer diameters than known pumps.

A further aim of the invention is to provide a multistage pump of the type specified above, conceived so that its internal components are highly modular, it significantly increases reliability even, and especially, with respect to current "fast" pumps, and has substantially no wear among the various components which are in mutual contact during pump operation.

With these and other aims in view, there is provided, according to the present invention, a multistage pump of the type which has a tubular containment jacket, a shaft coaxial to said tubular jacket and connected to a driving shaft, and a plurality of equidistant stages, each stage being formed by a radial-vane impeller with a front ring and by a flow distribution element which faces said impeller with a bowl-shaped supporting element interposed, wherein said impellers are mounted in a pack on said shaft coaxial to said jacket and can rotate together with said shaft, said multistage pump having, according to the present invention, said radial-vane impellers and their distribution elements rigidly coupled to said jacket made of highly wearproof materials, said impellers being mounted on said shaft and axially movable or floating with a preset stroke with respect to the associated bowl-shaped element, whereas at least one annular supporting and sealing element for the impeller is interposed between said front ring of each impeller and the associated bowl-shaped element and is made of a material which is more wearproof than the impellers so as to withstand the axial thrusts of the various stages and limit fluid seepage during pump operation.

More particularly, said highly wearproof materials that constitute the impellers and the diffusers are constituted of a ceramic material with a very high hardness value, comprised substantially between 400 and 2100 HV, whereas said materials that constitute the annular supporting elements of the front disk of each impeller are constituted of a ceramic material having a hardness value comprised between 1000 and 3000 HV, so as to allow the front disk of each impeller to adapt to the surface of the supporting element, utilizing the difference in hardness of the two materials, shortly after the beginning of the operation of the pump.

Each diffuser made of ceramic materials may be furthermore anchored to the respective bowl, which is in turn rigidly associated with said containment jacket, by means of an initial sliding engagement of raised portions or studs, which protrude from the inner wall of the bowl, within slots formed peripherally with respect to the diffuser to subsequently allow, after partial rotation of the bowl, the locking of said studs by screwing on inclined planes that rise from the base of said diffuser.

Each ceramic impeller is furthermore made of two mutually separate parts which are subsequently coupled by baking, one of said parts constituting the means for floating anchoring to the shaft, the other part constituting the vanes and the associated front disk.

BRIEF DESCRIPTION OF THE DRAWINGS

Further characteristics and advantages of the present invention will become apparent from the following detailed description thereof, given with reference to the accompanying drawings, which are provided only by way of non-limitative example and wherein.

DESCRIPTION OF THE PREFERRED EMBODIMENTS

Figure 1:
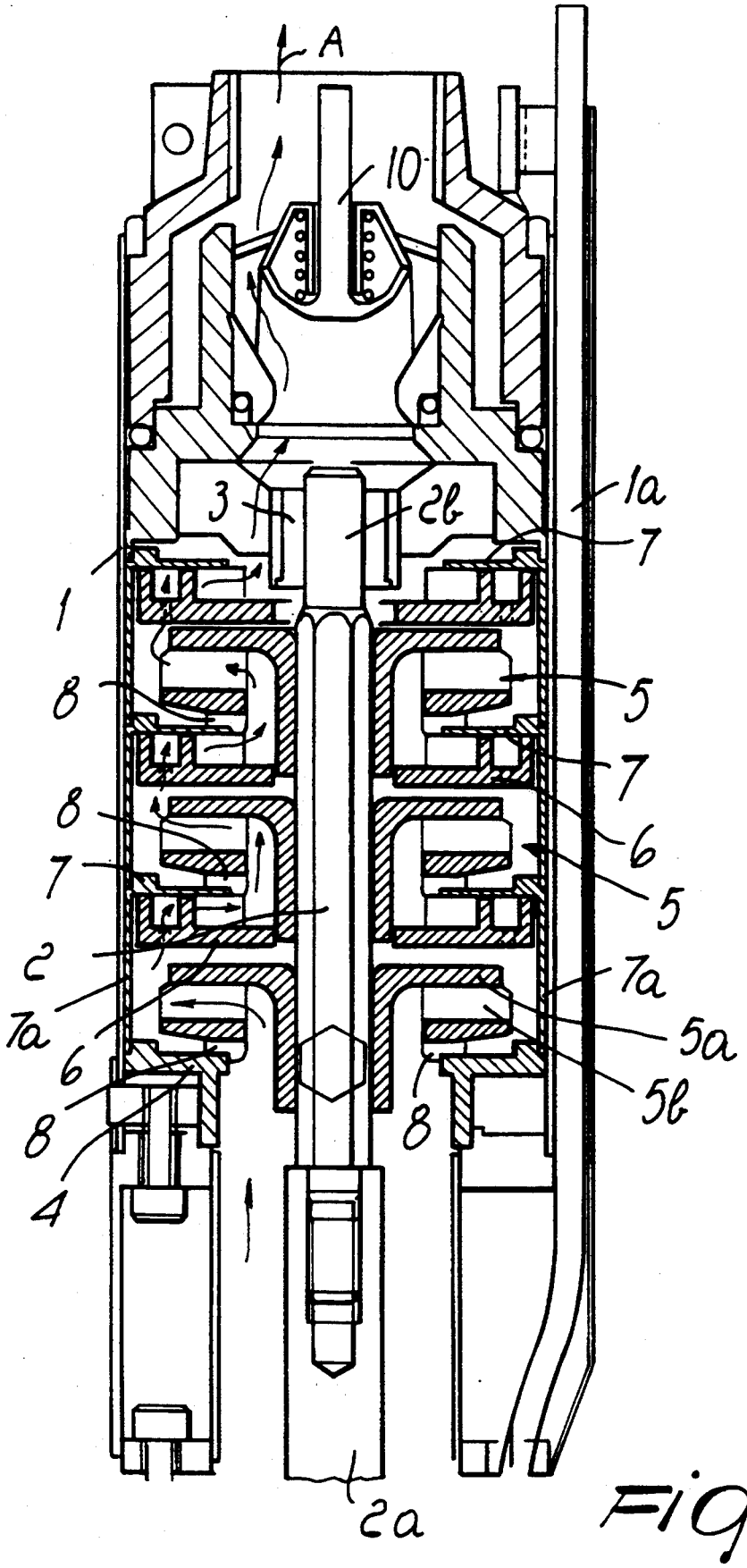
FIG. 1 is an axial diametrical sectional view of a multistage pump according to the invention, shown without the driving motor.

With reference to the above figures, the multistage pump according to the present invention, submersable in a liquid, comprises a tubular body or containment jacket 1 inside which a shaft 2 is rotatably mounted; said shaft 2 has a preferably polygonal transverse cross-section, and its lower end 2*a* is keyed directly onto the shaft of a electric motor, not illustrated in the figures, which does not have the conventional thrust bearing. A duct 1*a* is furthermore associated with said tubular body 1, and the cable for supplying electric power to the motor is inserted through said duct. The terminal part 2*b* of the central shaft 2 may be furthermore rotationally supported within a conventional bush 3.

A series of active stages is interposed between an annular supporting body 4, which is anchored to the internal surface of the hollow body or jacket 1, and said upper bush 3; each active stage comprises an impeller 5, a diffuser 6 and, between said impeller and said diffuser, a supporting element 7 which is substantially shaped like an inverted bowl or tray.

Each bowl 7 is rigidly anchored, with its cylindrical part 7*a*, to the internal surface of the jacket 1 so that its hollow bottom is at right angles and coaxial to the central shaft 2.

According to the present invention, all the impellers 5 and the associated diffusers 6 are made of wearproof ceramic materials with a hardness value substantially comprised between 400 and 2100 HV; said impellers are preferably manufactured in two parts: the first one, designated by the reference numeral 5*a* in FIG. 1, constitutes the element for anchoring to the central shaft 2, and the second one, designated by the reference numeral 5*b*, constitutes the vanes and the associated front rings. Said two separately produced parts can be mutually assembled, so as to form a single component, by baking according to conventional methods. Since the vanes are monolithic with their front disk-shaped part, it is thus possible to produce impellers with a different specific rpm rate using every time the same component 5*a*, which is in practice more complex than the part 5*b*.

All the impellers 5 are mounted on the central shaft 2 and can move freely on said shaft with a preset stroke with respect to the associated underlying bowl 7, so as to allow, during operation, the discharge of the axial thrusts not through the shaft 2 but through the hollow containment body, as will become apparent hereinafter.

For this purpose, the present invention provides for the insertion of an annular element 8 between the free face of each front disk-shaped part of the impeller and the base of the associated underlying bowl 7; said element 8 is anchored to the bowl and made of a ceramic material having a hardness comprised between 1000 and 3000 HV, so that the impellers (which are individually free to move axially on the shaft 2) rest frontally on the respective annular element 8 during operation, thus discharging the axial thrusts onto the element 8 and therefore onto the stator 1. The combination of movable or floating impellers with said annular elements 8 in practice replaces the conventional thrust bearing which is usually provided on the driving shaft and also allows to use impellers with a non-lapped front disk; the hardness of the ceramic materials that constitute the impellers and the annular supporting elements 8 allows in fact the spontaneous leveling of the surface of the front disks of the vanes, so that after a short period of operation, for example approximately one hour, the surface of the front disks is perfectly smooth and subsequently not subject to wear by virtue of the contact of two large surfaces.

The constant contact of the impellers with said annular element 8, in addition to ensuring correct support for the impellers, offers the advantage of ensuring high volumetric efficiency, limiting fluid seepage.

If a reversal in axial thrust accidentally occurs, the pump does not suffer any damage, since contact between the impeller and the upper diffuser 6 allows to temporarily withstand any reverse axial thrust.

Furthermore, to compensate for the modest axial forces due to the weight of the rotor (not including the impellers) and to the pressure acting on the lower part of the shaft 2, it is sufficient to axially rigidly couple a single impeller to said shaft 2.

Figure 2:
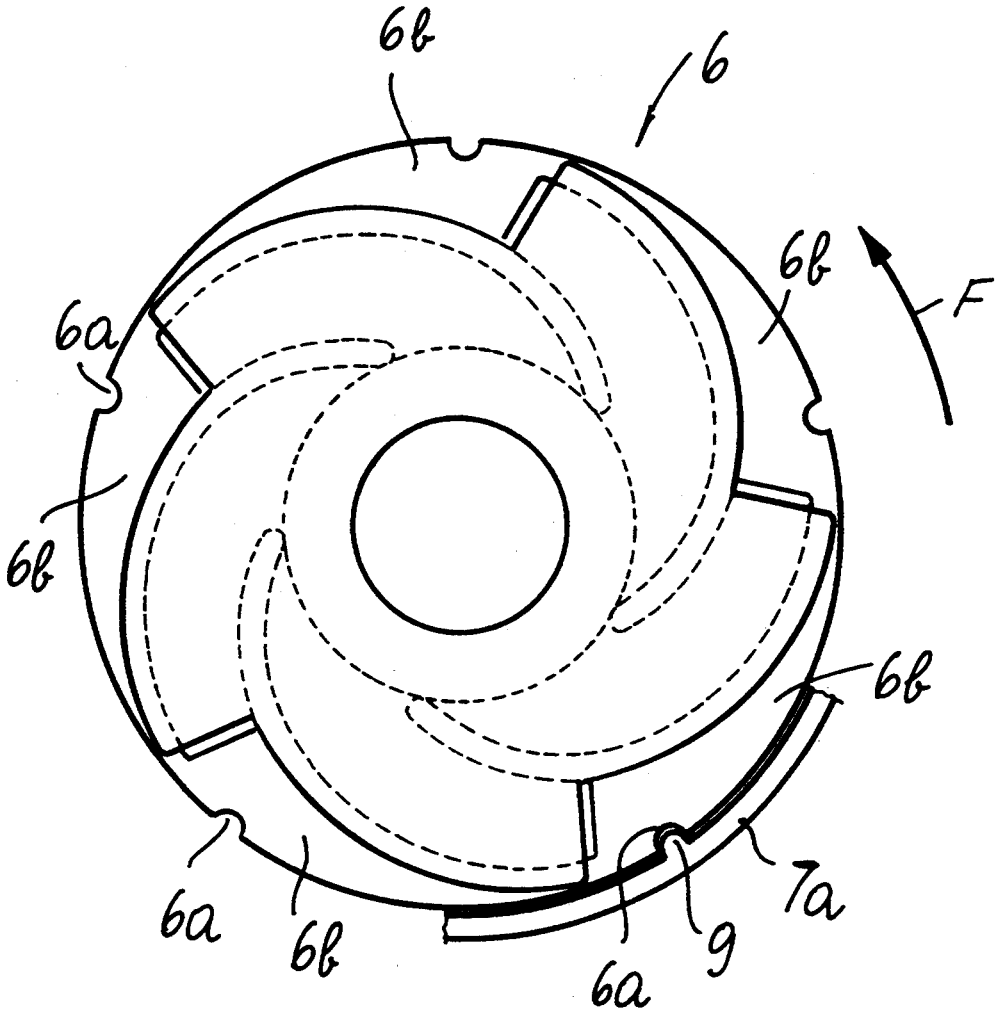
FIG. 2 is a plan view of the ceramic diffuser used in the pump of FIG. 1.

Finally, in order to stably lock the diffusers 6 within the respective inverted bowls 7 (FIG. 2), raised portions or studs 9 are provided on the internal cylindrical surface 7*a* of each bowl and can slide within the grooves 6*a* formed on the cylindrical outer surface of the associated diffuser 6; inclined planes 6*b* that extend from the base of the diffusers join at said grooves 6*a*. Upon rotation of the bowl 7 in the direction of the arrow F of FIG. 2, said studs slide along the inclined planes 6*b* and are consequently locked by screwing thereon. Once the diffusers have been locked in the respective bowls, stable locking is provided by forming at least one additional stud.

The above described pump may be furthermore provided with a conventional check valve 10 and with conventional means for drawing and expelling the fluid, the path of which inside the pump is schematically shown by the broken line arrows A (FIG. 1).

From what has been described above, it is evident that the pump according to the invention has a very high nominal rotation rate and thus a markedly higher specific fluid-dynamics performance than conventional ones. Furthermore, the advantages achieved can be identified as high compactness (it is possible to use, for an equal performance, smaller outer diameters), high modularity (it is possible to use a much smaller number of stages for an equal performance), and ultimately the possibility of replacing current submersed pumps having a 4-inch diameter with 3-inch pumps and current 6-inch submersed pumps with pumps having a 4-inch diameter.

Naturally, in its practical execution, the invention as described and illustrated above according to a preferred embodiment is susceptible to modifications and variations which are structurally and functionally equivalent without abandoning the protective scope of the invention.

We claim:

1. A submersible multistage pump comprising;

a tubular body (1) having an internal surface;

a shaft (2) mounted rotatably within said tubular body (1), and;

a plurality of pump stages (5, 6, 7) mounted on said shaft within said tubular body (1);

wherein each of said pump stages comprises;

a ceramic impeller (5) radially keyed to and axially slideable on said shaft (2), said impeller being made of a ceramic material and comprising a first part (5*a*) and a second disk-shaped part (5*b*), said first part (5*a*) being anchored to said shaft (2), said second disk-shaped part (5*b*) having formed thereon a plurality of vanes;

a ceramic diffuser (6) connected to said impeller (5);

a bowl-shaped supporting element (7) interposed between said impeller (5) and said diffuser (6) and having a cylindrical part (7*a*), said cylindrical part (7*a*) being rigidly connected to said internal surface of said tubular body (1), and;

a ceramic annular element (8) rigidly connected to said bowl-shaped supporting element (7);

wherein said impeller (5) rests on said annular element (8) during operation of said pump for discharging axial thrust onto said tubular body (1).

2. A submersible multistage pump according to claim 1, wherein said impeller (5) is made of a ceramic material having a hardness value of from 400 HV to 2100 HV, said diffuser (6) is made of ceramic material having a hardness value of from 400 HV to 2100 HV, and said annular element (8) is made of a ceramic material having a hardness value comprised between 1000 and 3000 HV.

3. A submersible multistage pump according to claim 1, wherein said diffuser (6) has a cylindrical outer surface, inclined planes (6*b*) defined on said cylindrical outer surface, and a plurality of grooves (6*a*) formed on said cylindrical outer surface, and wherein said bowl-shaped supporting element (7) has an internal cylindrical surface (7*a*), and a plurality of studs (9) formed on said internal cylindrical surface (7*a*), said studs (9) being slideable in said grooves (6*a*) along said inclined planes (6*b*) for threadedly locking said diffuser (6) in said bowl-shaped supporting element (7).

4. A submersible multistage pump comprising;

a tubular body (1) having an internal surface;

a bush (3) connected to said tubular body (1);

an annular supporting body (4) mounted in said tubular body (1) opposite said bush (3);

a shaft (2) mounted rotatably within said tubular body (1) and extending between said bush (3) and said annular supporting body (4), and;

a plurality of pump stages (5, 6, 7) located within said tubular body (1) between said bush (3) and said annular supporting body (4);

wherein each of said pump stages comprises an impeller (5) radially keyed to and axially slideable on said shaft (2), said impeller being made of a ceramic material having a hardness value of from 400 HV to 2100 HV and comprising a first part (5*a*) and a second disk-shaped part (5*b*), said first part (5*a*) being anchored to said shaft (2), said second disk-shaped part (5*b*) having formed thereon a plurality of vanes;

a diffuser (6) connected to said impeller (5) and made of ceramic material having a hardness value of from 400 HV to 2100 HV;

a bowl-shaped supporting element (7) interposed between said impeller (5) and said diffuser (6) and having a cylindrical part (7*a*), said cylindrical part (7*a*) being rigidly connected to said internal surface of said tubular body (1), and;

an annular element (8) rigidly connected to said bowl-shaped supporting element (7) and being made of a ceramic material having a hardness value comprised between 1000 and 3000 HV;

wherein said impeller (5) rests on said annular element (8) during operation of said pump for discharging axial thrust onto said tubular body (1).

5. A submersible multistage pump according to claim 4, wherein said diffuser (6) has a cylindrical outer surface, inclined planes (6*b*) defined on said cylindrical outer surface, and a plurality of grooves (6*a*) formed on said cylindrical outer surface, and wherein said bowl-shaped supporting element (7) has an internal cylindrical surface (7*a*), and a plurality of studs (9) formed on said internal cylindrical surface (7*a*), said studs (9) being slideable in said grooves (6*a*) along said inclined planes (6*b*) for threadedly locking said diffuser (6) in said bowl-shaped supporting element (7).

6. A submersible multistage pump comprising;

a tubular body (1) having an internal surface;

a bush (3) connected to said tubular body (1);

an annular supporting body (4) mounted in said tubular body (1) opposite said bush (3);

a shaft (2) mounted rotatably within said tubular body (1) and extending between said bush (3) and said annular supporting body (4), and;

a plurality of pump stages (5, 6, 7) located within said tubular body (1) between said bush (3) and said annular supporting body (4);

wherein each of said pump stages comprises a ceramic impeller (5) radially keyed to and axially slideable on said shaft (2), said impeller comprising a first part (5*a*) and a second disk-shaped part (5*b*), said first part (5*a*) being anchored to said shaft (2), said second disk-shaped part (5*b*) having formed thereon a plurality of vanes;

a ceramic diffuser (6) connected to said impeller (5), said diffuser (6) having a cylindrical outer surface, inclined planes (6*b*) defined on said cylindrical outer surface, and a plurality of grooves (6*a*) formed on said cylindrical outer surface;

a bowl-shaped supporting element (7) interposed between said impeller (5) and said diffuser (6) and having a cylindrical part (7*a*) and an internal cylindrical surface, said cylindrical part (7*a*) being rigidly connected to said internal surface of said tubular body (1), said internal cylindrical surface (7*a*) having formed thereon a plurality of studs (9), said studs (9) being slideable in said grooves (6*a*) along said inclined planes (6*b*) for threadedly locking said diffuser (6) in said bowl-shaped supporting element (7), and;

a ceramic annular element (8) rigidly connected to said bowl-shaped supporting element (7);

wherein said impeller (5) rests on said annular element (8) during operation of said pump for discharging axial thrust onto said tubular body (1).

7. A submersible multistage pump according to claim 6, wherein said impeller (5) is made of a ceramic material having a hardness value of from 400 HV to 2100 HV, said diffuser (6) is made of ceramic material having a hardness value of from 400 HV to 2100 HV, and said annular element (8) is made of a ceramic material having a hardness value comprised between 1000 and 3000 HV.

8. A submersible multistage pump comprising;

a tubular body (1) having an internal surface;

a bush (3) connected to said tubular body (1);

an annular supporting body (4) mounted in said tubular body (1) opposite said bush (3);

a shaft (2) mounted rotatably within said tubular body (1) and extending between said bush (3) and said annular supporting body (4), and;

a plurality of pump stages (5, 6, 7) located within said tubular body (1) between said bush (3) and said annular supporting body (4);

wherein each of said pump stages comprises an impeller (5) radially keyed to and axially slideable on said shaft (2), said impeller being made of a ceramic material having a hardness value of from 400 HV to 2100 HV and comprising a first part (5*a*) and a second disk-shaped part (5*b*), said first part (5*a*) being anchored to said shaft (2), said second disk-shaped part (5*b*) having formed thereon a plurality of vanes;

a diffuser (6) connected to said impeller (5), said diffuser (6) being made of ceramic material having a hardness value of from 400 HV to 2100 HV and having a cylindrical outer surface, inclined planes (6*b*) defined on said cylindrical outer surface, and a plurality of grooves (6*a*) formed on said cylindrical outer surface;

a bowl-shaped supporting element (7) interposed between said impeller (5) and said diffuser (6) and having a cylindrical part (7*a*) and an internal cylindrical surface, said cylindrical part (7*a*) being rigidly connected to said internal surface of said tubular body (1), said internal cylindrical surface (7*a*) having formed thereon a plurality of studs (9), said studs (9) being slideable in said grooves (6*a*) along said inclined planes (6*b*) for threadedly locking said diffuser (6) in said bowl-shaped supporting element (7), and;

an annular element (8) made of a ceramic material having a hardness value comprised between 1000 and 3000 HV, said annular element (8) being rigidly connected to said bowl-shaped supporting element (7);

wherein said impeller (5) rests on said annular element (8) during operation of said pump for discharging axial thrust onto said tubular body (1).

* * * * *